US006880795B1

(12) United States Patent
Haynes, III

(10) Patent No.: US 6,880,795 B1
(45) Date of Patent: Apr. 19, 2005

(54) PICTURE HANGER

(76) Inventor: Boyd Haynes, III, 10 Ferguson Cove, Newport News, VA (US) 23606

( * ) Notice: Subject to any disclaimer, the term of this patent is extended or adjusted under 35 U.S.C. 154(b) by 0 days.

(21) Appl. No.: 10/624,162

(22) Filed: Jul. 22, 2003

(51) Int. Cl.[7] ..... A47F 7/14
(52) U.S. Cl. ..... 248/475.1
(58) Field of Search ..... 248/475.1, 476, 248/495, 480, 489, 493

(56) References Cited

U.S. PATENT DOCUMENTS 4,171,117 A 10/1979 Prochaska
4,212,123 A 7/1980 Robin
4,228,982 A 10/1980 Sellera
4,566,665 A * 1/1986 Rynearson ..... 248/495
4,597,554 A 7/1986 James
4,827,648 A 5/1989 Danin
4,892,284 A * 1/1990 Kelrick ..... 248/476
4,912,864 A 4/1990 Price
4,973,021 A * 11/1990 Schuite ..... 248/495
5,749,558 A 5/1998 Wallo
5,806,826 A * 9/1998 Lemire ..... 248/476
5,848,489 A 12/1998 Hartley et al.
6,062,525 A * 5/2000 Lemire ..... 248/475.1

* cited by examiner

*Primary Examiner*—Leslie A. Braun
*Assistant Examiner*—Kofi Schulterbrandt
(74) *Attorney, Agent, or Firm*—Donald R. Schoonover

(57) ABSTRACT

A picture hanger has two portions that are movably connected to each other. One portion is fixed to a picture to be hung on a support, and one portion is attached to a picture hanging element, such as a nail, or a picture hanging hook, or the like that is fixed to a support such as a wall. The portions of the picture hanger are moved with respect to each other to locate and orient the picture once the picture is hung on the support.

3 Claims, 1 Drawing Sheet

PICTURE HANGER

BACKGROUND OF THE INVENTION

1. Field of the Invention

The present invention relates to the general art of supports, and to the particular field of picture hangers.

2. Discussion of the Related Art

One of the most frustrating aspects of hanging a picture is the difficulty in properly positioning and orienting the picture. The picture must be located on the support structure in relation to the support structure as well as in relation to other items already supported on the support structure. The picture must then be oriented to be level.

This often requires a picture to be hung, and then re-hung one or more times to locate and orient the picture in the desired location and orientation. This may require several holes to be placed in a wall which can be a problem. This process can mar the support structure and can be time consuming.

Therefore, there is a need for a means for hanging a picture on a support structure which is expeditious, accurate and precise.

While the art contains several examples of picture hanging devices, these known devices are generally complex and difficult to use.

Therefore, there is a need for a means for hanging a picture on a support structure which is expeditious, accurate and precise yet is simple and easy to use.

PRINCIPAL OBJECTS OF THE INVENTION

It is a main object of the present invention to provide a means for hanging a picture on a support structure which is expeditious, accurate and precise.

It is another object of the present invention to provide a means for hanging a picture on a support structure which is expeditious, accurate and precise yet is simple and easy to use.

SUMMARY OF THE INVENTION

These, and other, objects are achieved by a picture hanger that has a first portion fixedly attached to a picture a second portion which is fixedly attached to a support structure, and a movable connection between the first and second portions that causes the second portion to move with respect to the first portion when the connection is operated.

Using the picture hanger embodying the present invention, a picture can be quickly, easily and precisely hung by simply locating a support, such as a nail or a picture hook, in the position where the portion of the picture hanger that is fixed to the support is to be located, then attaching the other portion of the picture hanger to the picture. The picture hanger is then attached to the nail or picture hook and the connection of the picture hanger operated to move the picture into the desired location and orientation. The picture hanger embodying the present invention includes a screw-type connection for effecting movement of the movable connection.

BRIEF DESCRIPTION OF THE DRAWING FIGURES

DETAILED DESCRIPTION OF THE PREFERRED EMBODIMENT

Figure 4:
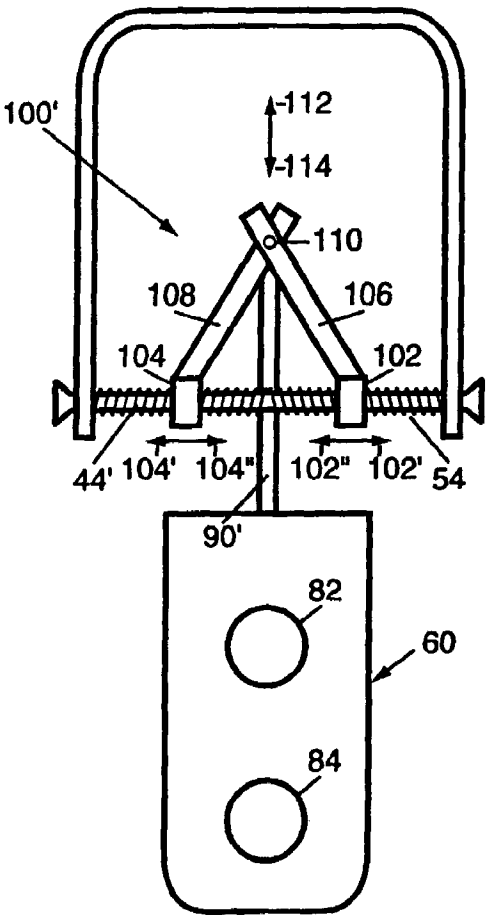
FIG. 4 is a front elevational view of a picture hanger having one form of movable connection, according to the present invention.

Other objects, features and advantages of the invention will become apparent from a consideration of the following detailed description and the accompanying drawings.

Referring to the Figures, it can be understood that the present invention is embodied in a picture hanger 10 that will be used to mount a picture or the like on a support such as a wall. Once the picture is mounted on the wall, it can be moved to position the picture and orient the picture in the desired manner by simply engaging a screw driver with the picture hanger and adjusting the picture hanger as necessary.

Picture hanger 10 comprises a U-shaped support element 12 which, in use, is attached to a support structure, such as a wall W. U-shaped support element 12 has a first leg 14 having a first end 16, a second end 18, and a longitudinal axis 20 which extends between the first end 16 of the first leg 14 and the second end 18 of the first leg 14. A second leg 22 has a first end 24, a second end 26, and a longitudinal axis 28 which extends between the first end 24 of the second leg 22 and the second end 26 of the second leg 22. The longitudinal axis 28 of the second leg 22 is parallel to the longitudinal axis 20 of the first leg 14.

A bight section or leg 30 has a first end 32 connected to the first end 16 of the first leg 14, a second end 34 connected to the first end 24 of the second leg 22, and a longitudinal axis 36 which extends between the first end 32 of the bight section 30 and the second end 34 of the bight section 30. The longitudinal axis 36 of the bight section 30 extends transverse to the longitudinal axis 20 of the first leg 14 and the longitudinal axis 28 of the second leg 22.

The bight section 30 is supported on an element E, such as a nail or a picture hook, or the like, that is fixedly mounted on wall W to support a picture, or the like.

A first adjusting element support 40 is located on the second end 18 of the first leg 14, and a second adjusting element support 42 is located on the second end 26 of the second leg 22. The adjusting element supports 40, 42 can include tubular elements.

An adjusting element 44 is movably mounted in the first and second adjusting-support elements 40, 42. The adjusting element 44 has a first end 46 adjacent to the first adjusting support element 42, a second end 48 adjacent to the second adjusting element support and a longitudinal axis 50 which extends between the first end 46 of the adjusting element 44 and the second end 48 of the adjusting element 44 and which, in use, extends parallel to the longitudinal axis 36 of the bight section 30. The adjusting element 44 includes an exterior surface 52, a screw thread 54 on the exterior surface 52 of the adjusting element 44, a first screw-driver accommodating head 56 on the first end 46 of the adjusting element 44, and a second screw-driver accommodating head 58 on the second end 48 of the adjusting element 44. The screw-driver accommodating heads 56, 58 can include Phillips head screw driver accommodating elements as well as blade screw driver head accommodating elements.

Figure 1:
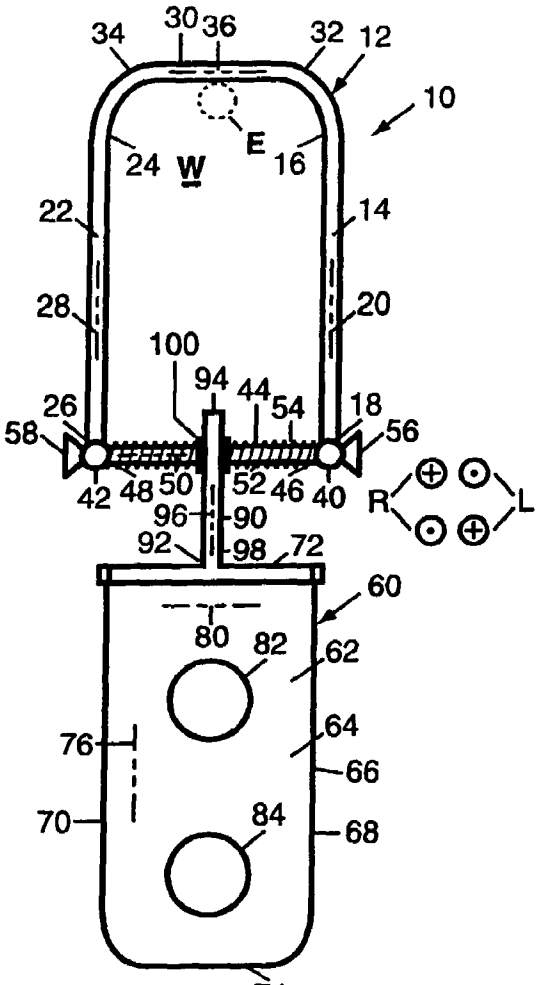
FIG. 1 is a front elevational view of the picture hanger embodying the present invention, according to the present invention.

Adjusting element 44 is movably mounted on the U-shaped support element 12 to rotate about longitudinal axis 50 of the adjusting element 44 under influence of a screw driver accommodated in either the first screw-driver accommodating head 56 or the second screw-driver accommodating head 58. The rotation of the adjusting element 44 is indicated in FIG. 1 by the indicators R and L which indicate that the adjusting element 44 can be rotated in either of two directions.

A support plate 60 is fixedly attached to a picture when in use and includes a planar body 62 which has a first planar surface 64, a second planar surface 66, a first side edge 68, a second side edge 70, a first end edge 72, a second end edge 74, and a longitudinal axis 76 which extends between the first end edge 72 of the support plate 60 and the second end edge 74 of the support plate 60 and which extends in the direction of the longitudinal axis 20 of the first leg 14 of the U-shaped support element 12. A transverse axis 80 extends between the first side edge 68 of the support plate 60 and the second side edge 70 of the support plate 60. Transverse axis 80 extends in the direction of the longitudinal axis 36 of the bight leg 30 of the U-shaped support element 12 in use. Two mounting fastener accommodating holes 82 and 84 are defined through the support plate 60 from the first planar surface 64 to the second planar surface 66. The mounting fastener accommodating holes 82, 84 are spaced apart from each other in the direction of the longitudinal axis 76 of the planar body 62 of the support plate 60.

In use, the longitudinal axis 76 of the planar body 62 of the support plate 60 extends in the direction of the longitudinal axis 28 of the first leg 14 of the U-shaped support element 12.

A post 90 has a first end 92 fixedly connected to the first end edge 72 of the planar body 62 of the support plate 60, a second end 94, a longitudinal axis 96 which extends between the first end 92 of the post 90 and the second end 94 of the post 90. The longitudinal axis 96 of the post 90 extends in the direction of the longitudinal axis 76 of the planar body 62 of the support plate 60. The post 90 may have screw threads 98 thereon.

A connection unit 100 connects the post 90 to the adjusting element 44 in a manner in which rotational movement of the adjusting element 44 causes linear movement of the post 90 in the direction of the longitudinal axis 96 of the post 90 so the support plate 60 is moved toward and away from the bight leg 30 of the U-shaped support element 12 when the adjusting element 44 is rotated about the longitudinal axis 50 of the adjusting element 44.

Connection unit 100 can be a connection such as used in machine outdrives, or the like. Another form of the connection unit is shown in FIG. 4 as connection unit 100 and includes a right-handed nut 102 and a left-handed nut 104 mounted on adjusting element 44'. The nuts 102, 104 have screw threads that engage the screw threads 54 of the adjusting element 44 and move in the directions 102' and 102" and 104' and 104" when the adjusting element 44 is rotated in directions R and L. Lever arms 106 and 108 are connected at one end thereof to the nuts 102 and 104 respectively. A pivot connection 110 connects lever arm 106 to lever arm 108 at a location spaced apart from the nuts 102 and 104. As can be understood from FIG. 4, the right- and left-handed nuts 102, 104 and connecting levers 106, 108 raise and lower post 90' in directions 112 and 114 as the adjusting element 44 is rotated in directions R and L.

Figure 2:
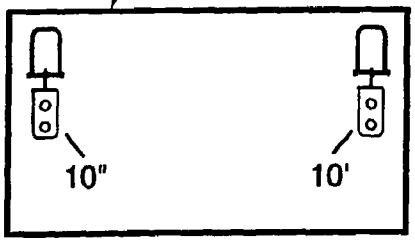
FIG. 2 is a rear elevational view of a picture having two picture hangers of the present invention mounted thereon.
Figure 3:
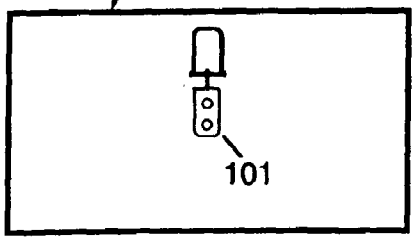
FIG. 3 is a rear elevational view of a picture having one picture hanger of the present invention mounted thereon.

A picture frame, such as frame F1 shown in FIG. 2, can be mounted on a support by two spaced apart picture hangers 10' and 10", or a picture frame such as frame $F_2$ shown in FIG. 3 can be mounted on a support by a single picture hanger 101. The picture hangers shown in FIGS. 2 and 3 are identical to the picture hanger shown in FIG. 1 or 4 and thus will not be further discussed, except to note that the picture hangers have support plates that are fixed to the picture frame and U-shaped support elements that are hung on nails, or the like, that are mounted on a wall, or the like. It is also noted that the nails can be replaced by a picture wire attached at each end to a picture hanger and extending over a nail or picture hook mounted on a wall or the like. Other variations will occur to those skilled in the art based on the teaching of this disclosure. Each picture hanger can be adjusted as necessary to locate and orient the picture as desired. Each picture hanger can be adjusted up or down as required.

It is understood that while certain forms of the present invention have been illustrated and described herein, it is not to be limited to the specific forms or arrangements of parts described and shown.

What is claimed and desired to be covered by Letters Patent is:

1. A picture hanger comprising:

a) a U-shaped support element which is attached to a support structure, such as a wall, in use, said U-shaped support element having (1) a first leg having a first end, a second end, and a longitudinal axis extending between the first end of the first leg and the second end of the first leg, (2) a second leg having a first end, a second end, and a longitudinal axis extending between the first end of the second leg and the second end of the second leg, the longitudinal axis of the second leg being parallel to the longitudinal axis of the first leg, (3) a bight section having a first end connected to the first end of the first leg, a second end connected to the first end of the second leg, and a longitudinal axis extending between the first end of the bight section and the second end of the bight section, the longitudinal axis of the bight section extending transverse to the longitudinal axis of the first leg and the longitudinal axis of the second leg, (4) a first adjusting element support on the second end of the first leg, and (5) a second adjusting element support on the second end of the second leg;

b) an adjusting element movably mounted in the first and second adjusting element supports, said adjusting element having (1) a first end adjacent to the first adjusting element support, (2) a second end adjacent to the second adjusting element support, (3) a longitudinal axis extending between the first end of the adjusting element and the second end of the adjusting element and extending parallel to the longitudinal axis of the bight section in use, (4) an exterior surface, (5) a screw thread on the exterior surface of said adjusting element, (6) a first screw-driver accommodating head on the first end of the adjusting element, and (7) a second screw-driver accommodating head on the second end of the adjusting element;

c) said adjusting element being movably mounted on said U-shaped support element to rotate about the longitudinal axis of said adjusting element under influence of a screw driver accommodated in either the first screw-driver accommodating head or the second screw-driver accommodating head;

d) a support plate which is fixedly attached to a picture when in use and which includes a planar body having a first planar surface, a second planar surface, a first side edge, a second side edge, a first end edge, a second end edge, a longitudinal axis extending between the first end edge of said support plate and the second end edge of said support plate and which extends in the direction of the longitudinal axis of the first leg of said U-shaped support element, a transverse axis extending between the first side edge of said support plate and the second side edge of said support plate and which extends in the direction of the longitudinal axis of the bight leg of said U-shaped support element in use, two mounting fastener accommodating holes defined through said support plate from the first planar surface to the second planar surface, the mounting fastener accommodating holes being spaced apart from each other in the direction of the longitudinal axis of the planar body of said support plate;

e) the longitudinal axis of the planar body of said support plate extending in the direction of the longitudinal axis of the first leg of said U-shaped support element in use;

f) a post having a first end fixedly connected to the first end edge of the planar body of said support plate, a second end, a longitudinal axis extending between the first end of the post and the second end of the post, the longitudinal axis of said post extending in the direction of the longitudinal axis of the planar body of said support plate; and g) a connection unit which connects said post to said adjusting element in a manner in which rotational movement of said adjusting element causes linear movement of said post in the direction of the longitudinal axis of said post so said support plate is moved toward and away from the bight leg of said U-shaped support element when said adjusting element is rotated about the longitudinal axis of said adjusting element.

2. The picture hanger as described in claim 1 further including a picture frame on which said support plate is fixedly attached, and a second support plate fixedly attached to said picture frame.

3. The picture hanger as described in claim 1 wherein said connection unit includes a screw thread.

* * * * *